US005591072A

United States Patent [19]

Tweed et al.

[11] Patent Number: 5,591,072

[45] Date of Patent: Jan. 7, 1997

[54] SHARPENING DEVICE FOR FOOD SLICER

[75] Inventors: Brian A. Tweed, Dracut; Peter M. DeBakker; Michael W. Osborne, both of Hudson, all of Mass.; Richard P. Scherch, Piqua, Ohio; Harvey A. Kasinoff; Tom B. Heckman, both of Troy, Ohio; Danny J. Mitchell, Harrison, Ohio; Mark Xie, Tipp City, Ohio

[73] Assignee: Premark FEG Corporation, Wilmington, Del.

[21] Appl. No.: 419,370

[22] Filed: Apr. 10, 1995

[51] Int. Cl.[6] ..... B24B 3/54

[52] U.S. Cl. ..... 451/293; 451/420; 451/422; 451/423

[58] Field of Search ..... 30/138, 139; 83/174, 83/174.1; 451/293, 419, 420, 422, 423

[56] References Cited

U.S. PATENT DOCUMENTS

| | | | |
|---|---|---|---|
| 889,830 | 6/1908 | Van Berkel . | |
| 908,896 | 1/1909 | Smith . | |
| 1,051,734 | 1/1913 | DeGroot | 451/422 |
| 1,419,552 | 6/1922 | Freed . | |
| 1,483,878 | 2/1924 | Hand . | |
| 1,884,924 | 10/1932 | Van Berkel | 451/422 |
| 1,939,740 | 12/1933 | Van Berkel | 451/422 |
| 1,943,642 | 1/1934 | Van Berkel | 451/422 |
| 2,150,585 | 3/1939 | Mahler | 146/101 |
| 2,412,962 | 12/1946 | Brookhart et al. | 146/102 |
| 2,486,797 | 11/1949 | Meyer | 146/102 |
| 2,488,421 | 11/1949 | Meeker et al. | 146/102 |
| 2,531,184 | 11/1950 | Wood | 51/248 |
| 2,709,325 | 5/1955 | Green et al. | 451/422 |
| 2,970,624 | 2/1961 | Lundell | 146/102 |
| 3,182,700 | 5/1965 | Engi | 146/102 |
| 3,225,802 | 12/1965 | Engi | 146/102 |
| 3,298,413 | 1/1967 | Engi | 146/102 |
| 3,958,478 | 5/1976 | Camper | 83/174 |
| 3,986,304 | 10/1976 | Shie, III | 51/248 |
| 4,019,286 | 4/1977 | Spooner et al. | 451/422 |
| 4,173,846 | 11/1979 | Steiner et al. | 451/422 |
| 4,685,364 | 8/1987 | Scheflow et al. | 83/68 |
| 4,817,480 | 4/1989 | Young | 83/174 |
| 5,101,704 | 4/1992 | Jones et al. | 83/174 |
| 5,209,150 | 5/1993 | Arconada Arconada | 83/174 |

FOREIGN PATENT DOCUMENTS 2252718 8/1992 United Kingdom .

*Primary Examiner*—Timothy V. Eley
*Attorney, Agent, or Firm*—Thompson, Hine & Flory L.L.P.

[57] ABSTRACT

The invention is a sharpener for a knife of a food slicer. The sharpener includes a base assembly and a sharpener assembly. The base assembly includes a lever mounted thereto on a pivot; the lever carrying a cam member which extends therefrom. The sharpener assembly includes a housing and a longitudinal cavity, a sharpening wheel mounted for rotation on an axle which reciprocates lengthwise in the cavity, a compression spring positioned in the cavity at the base of the axle, and an actuator which reciprocates in the cavity portion on the side of the spring opposite the axle. Upon moving the lever about its pivot, the cam contacts the actuator and moves the actuator in the direction of the axle and compresses the spring. The spring moves the plunger lengthwise within the cavity and urges the sharpening wheel against the knife.

21 Claims, 6 Drawing Sheets

SHARPENING DEVICE FOR FOOD SLICER

BACKGROUND OF THE INVENTION

The present invention relates to an apparatus for sharpening the knife blade of a food slicer. More particularly, this invention relates to a sharpener which is always in an active position and is actuated against the knife by using a single lever and cam.

Typical food slicers have a rotatable, circular or disc-like slicing knife, a gauge plate for determining the thickness of the slice and a carriage for supporting the food as it is moved past the cutting edge of the knife during slicing.

It is known that the knife blade of a slicer dulls from use. Therefore, a sharpener is needed to sharpen the blade for improved cutting of the blade. Sharpening stones are typically brought against the knife's cutting edge as the circular knife is rotated in order to sharpen the knife.

However, it is common practice to move the sharpener from an inactive or stowed position on a separate portion of the slicer housing to an active or sharpening position by some external means.

For example, U.S. Pat. No. 1,483,878 to Hand teaches sharpening wheels which are biased against the slicer knife by a compression spring. However, the sharpener must be rotated between an operating position and an inoperative, stowed position below the tray by means of a pivot pin.

U.S. Pat. No. 3,225,802 to Engi teaches a sharpening unit on a frame which is pivotally supported on a pivot pin. The sharpener is pivoted and folded down into a recess when not in use.

U.S. Pat. Nos. 5,101,704 and 3,958,478 to Jones et al. and Camper, respectively, teach the "up and over" approach in which the sharpener is mounted to a pair of parallel slots in a bracket extending from the slicer. The sharpener has fixed pins which cooperate with the open-ended slots to enable the sharpener to be moved between active and inactive positions.

U.S. Pat. No. 5,209,150 to Arconada teaches a sharpener which is mounted in a position from which the slicer knife can be sharpened without moving the sharpener from a stowed position. A control knob is pushed in and rotated until the shaft applied pressure to press the sharpener against the blade.

There are several disadvantages to using the above-mentioned sharpeners. First, the slicer housing must be able to supply a recess or place to store the sharpener when in the stowed position. Second, it takes the user an added amount of time if they must stop and maneuver the sharpener into the active position. Third, the sharpeners are not easily removable for cleaning and replacing the stone should it wear.

Accordingly, there exists a need for an apparatus in which the sharpener does not need to be moved from a stowed position to a sharpening or active position; an apparatus in which the sharpener stone is easily moved into position to apply pressure to the knife; and an apparatus which can readily be removed from the slicer for cleaning.

SUMMARY

The present invention is a sharpener which is always in an active position on the slicer. The sharpener is easily moved into contact with the blade through the rotation of a single lever. The lever actuates a cam which in turn pushes and compresses a spring loaded sharpening stone assembly. Simultaneously, a side arm on the spring loaded assembly actuates a truing arm into contact with the knife for deburring the knife edge. The sharpener is composed of two major assemblies: the base frame assembly which is preferably mounted to the slicer and the sharpener assembly which may lock onto the base frame but is readily removable for cleaning.

Optionally, the sharpener includes a scraper to clean the knife before sharpening and a shutter which covers the sharpener when not in use to prevent food particles and other debris from "contaminating" the sharpening stone.

Therefore, it is an object of the present invention to provide an apparatus in which the sharpener does not need to be moved from a stowed position to a sharpening or active position, but is always in a ready position; to provide an apparatus in which the sharpener stone is easily moved into position to apply pressure to the knife using a single lever and cam; to provide a sharpener which is relatively easy to maintain and can be readily removed from the slicer for cleaning.

Other objects and advantages of the present invention will become apparent form the following description, the accompanying drawings and the appended claims.

DETAILED DESCRIPTION OF THE PREFERRED EMBODIMENT

Figure 1:
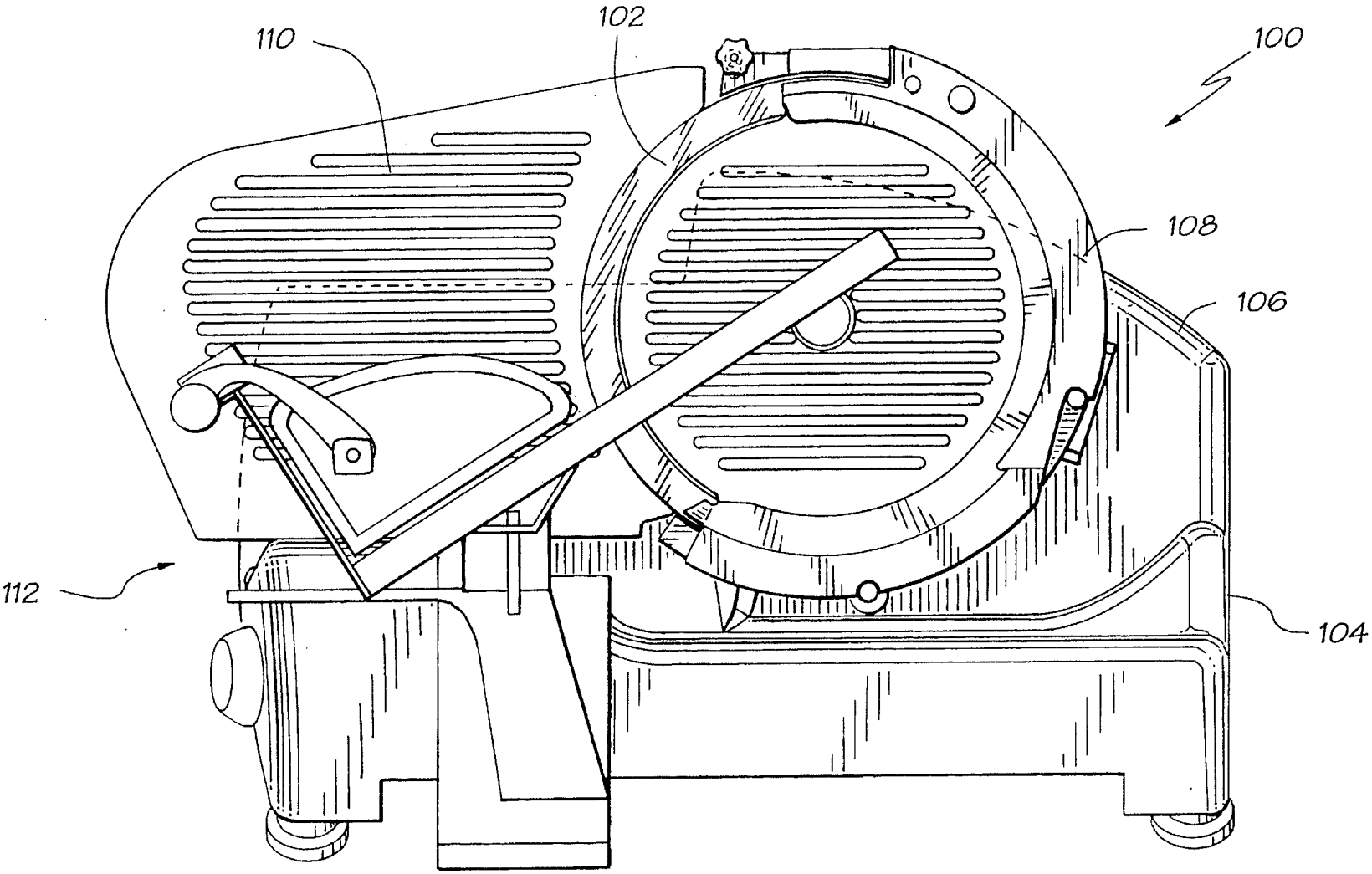
FIG. 1 PRIOR ART
FIG. 1 is a front elevational view of a conventional food slicer.

A typical food slicing machine 100 is shown in FIG. 1. It has a rotatable circular or disc-like slicing knife 102 mounted on a housing 104. The knife is mounted for rotation on a fixed axis shaft 106. The slicer 100 conventionally uses a ring guard (not shown) fastened thereto for the user's protection from the sharp edge of the slicing knife 102. The slicer 100 includes a cover plate 108 which is placed over the knife 102 and ring guard so that only a small portion of the knife blade is exposed. The slicer also includes a gauge plate 110 used to guide the food to be sliced and alter the thickness of the slices. The food is supported on carriage 112 which reciprocates in front of the blade.

In a typical embodiment of the present invention, a slicer is provided which includes a sharpener assembly which is mountable on a food slicer and a base assembly for supporting the sharpener assembly. The sharpener preferably includes two sharpening stones which opposingly engage the front and the rear faces of the knife blade simultaneously to grind and hone a fine edge on the knife. The main sharpening stone is on the back side of the knife, i.e., the side opposite the food, and comprises a circular sharpening stone mounted on an axle for rotation. A stone carried on a truing arm comes in contact with the front side of the knife to deburr the sharpened knife edge. In order to place the stones in an active position, the cam lever is mounted on the base assembly on a pin about which it can be rotated such that a cam follower carried on the lever actuates an actuator body and forces the sharpening stone against the knife as the cam follower travels across the back of the actuator. A further feature of the present invention is that the cam and lever arm are mounted on the base assembly in such a way that the sharpener assembly is readily removable to facilitate cleaning and replacement of the sharpening stones.

This system will now be described in detail below with respect to the figures. It is to be understood that the foregoing general description and the following detailed description are exemplary and explanatory but are not to be restrictive of the invention. The accompanying drawings which are incorporated in and constitute a part of this invention, illustrate the embodiments of the invention, and, together with the description, serve to explain the principles of the invention in general terms. Like numerals refer to like parts throughout the disclosure.

Figure 2:
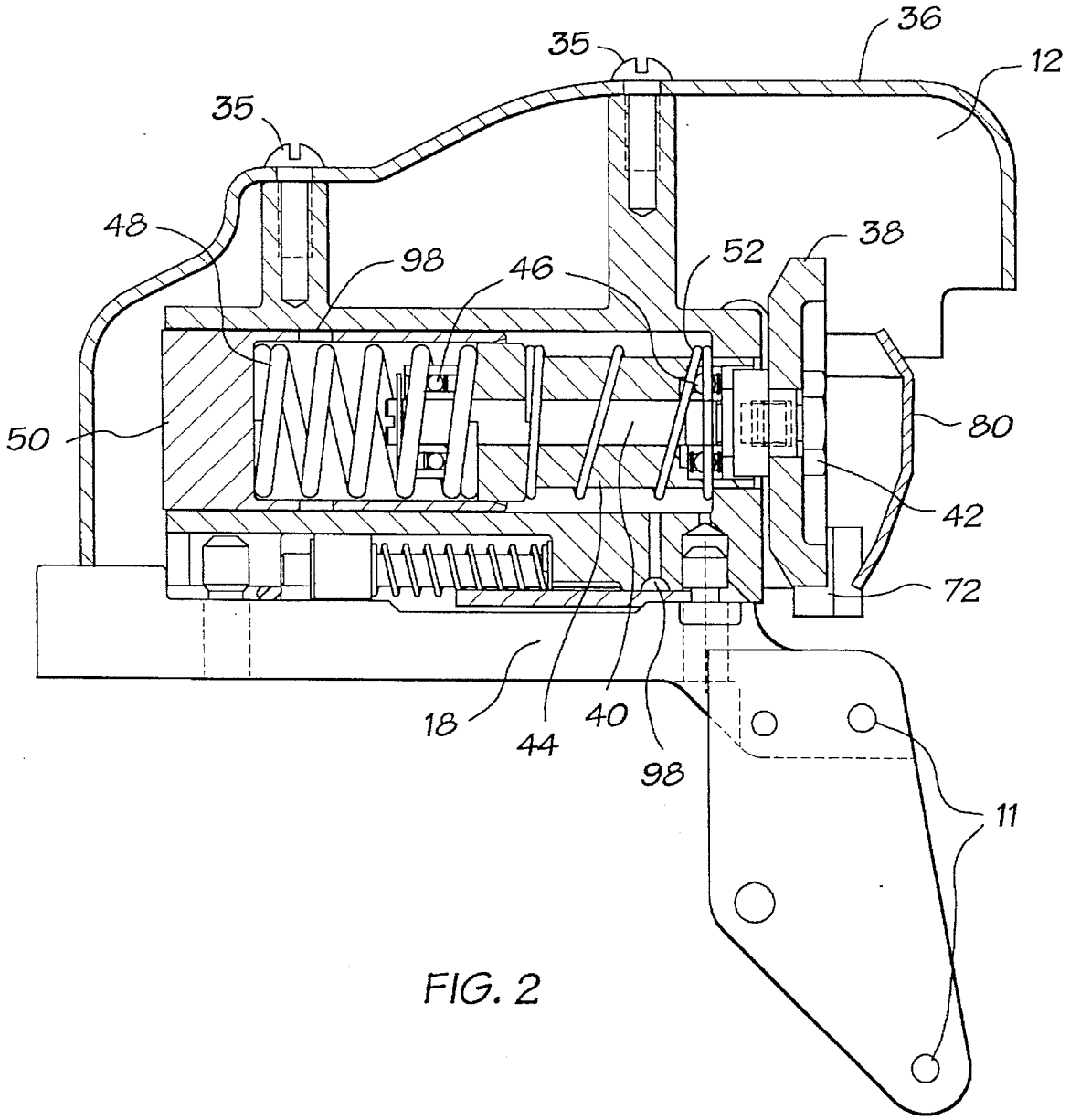
FIG. 2 is a sectional view of a food slicer sharpener on a base assembly according to the present invention.
Figure 3:
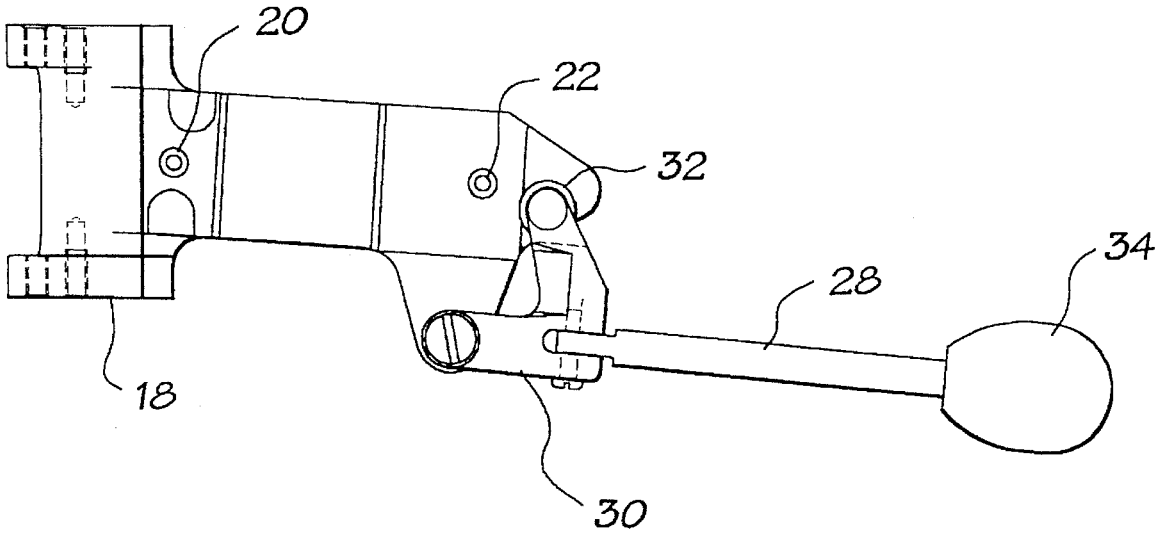
FIG. 3 is a top view of the base assembly.
Figure 5:
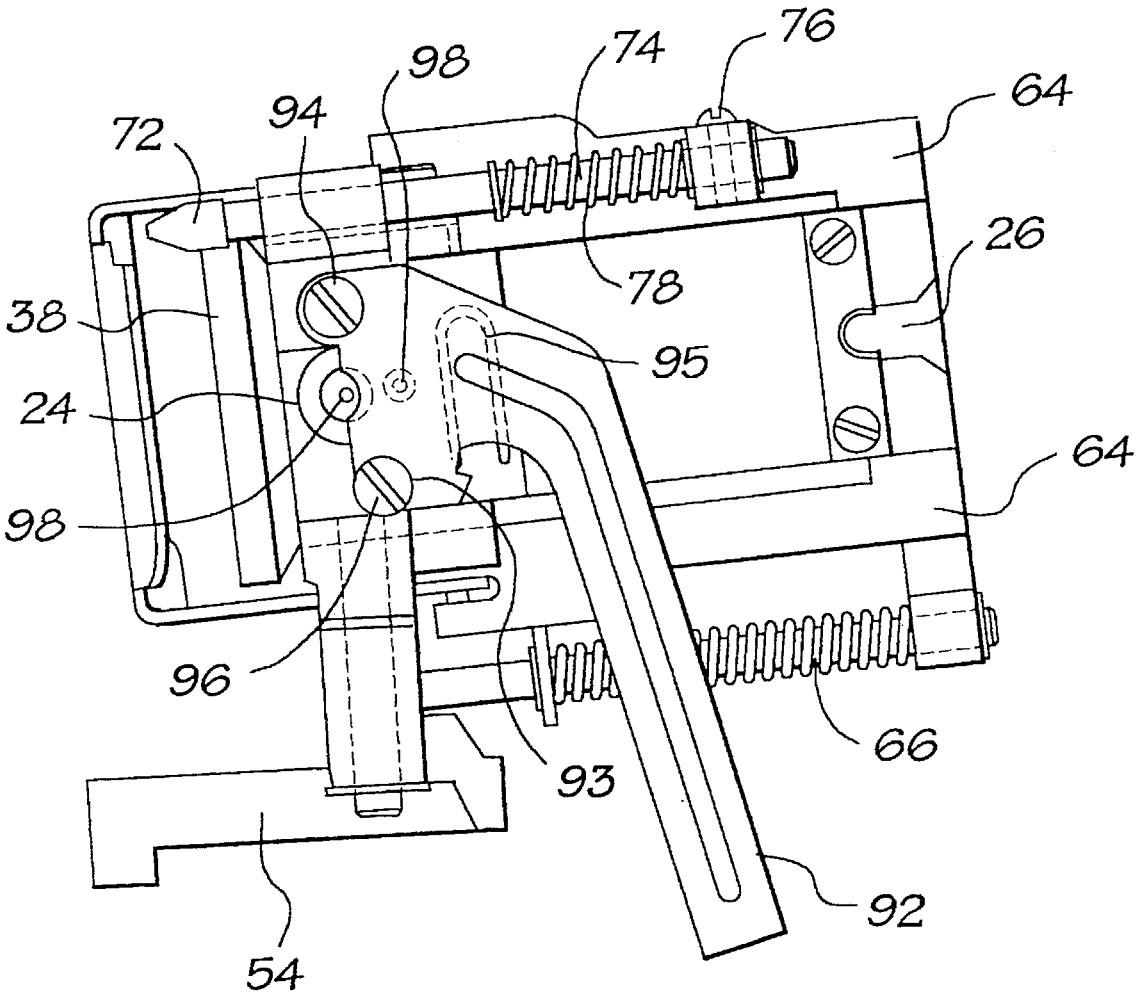
FIG. 5 is a bottom view of the sharpener assembly of FIG. 1.

FIG. 2 discloses a base assembly 18 mounted in a fixed position onto the food slicer by bracket 11. Base assembly 18 supports the sharpener assembly 12. The base assembly 18 is mounted at an angle to the slicer so that the sharpening stone 38 contacts the knife at a suitable angle. Preferably, the sharpener is angled 26° downward with respect to the knife and at a 3½° pitch. As shown in FIG. 3, the base assembly 18 includes a front mounting pin 20, a rear mounting pin 22, an actuator lever 28, cam 30, and a cam roller 32. In addition, the lever 28 may be provided with a handle knob 34. The sharpener assembly 12 includes a front locator hole 24 and a rear locator slot 26 as shown in FIG. 5, which respectively receive pins 20 and 22 on the base assembly 18. A locking lever 92 is provided on the sharpener assembly 12 which rotates on locking lever pivot 94, which mounts and holds the sharpener assembly 12 on the base assembly 18. The locking lever includes a recess 93, a spring 95, and a retainer 96 such that the locking lever 92 will spring into place by rotating around pivot 94 and engaging the retainer 96 in order to prevent the disengaging of the sharpener assembly from the base during use.

As an alternative, the base assembly and the sharpener assembly may comprise a single unit. However, having the sharpener assembly as a separate removable piece facilitates cleaning of the sharpener.

As shown in FIG. 2 the sharpener assembly 12 includes a cover 36, which is bolted to the assembly by screws 35. The sharpener assembly 12 includes a sharpening stone 38 which is retained on an axle 40 by a stone retaining screw 42. The axle 40 is mounted for axial rotation within a plunger 44 on sealed bearings 46,46 which ensure easy rotation of the axle 40 within the plunger 44.

The sharpener assembly also includes an actuator body 50. The plunger 44 is reciprocally received in a cavity in a cylindrical end piece of the actuator body 50. The actuator has been designed such that the actuator will keep the slot in the sharpener assembly 12 covered in all modes of operation. The actuator body includes a compression spring 48 therein which provides the compressive force of the sharpening stone 38 against the knife as will be described hereinbelow. The pressure with which the sharpening stone contacts the knife is a function of the main sharpening spring 48. As the knife is sharpened the sharpening spring is compressed to apply sufficient pressure for the stone to contact and sharpen the knife as the knife rotates. The force applied by the main sharpening stone 38 on the knife can be varied if necessary by replacing the main sharpening spring. A secondary spring, return spring 52, circles the plunger body 44. When compressed, the secondary spring provides the force to return the sharpener assembly to its original position after completion of the sharpening.

The sharpening wheel 38 is preferably made of electroplated cubic boron nitride (CBN), though other sharpening stones may be used as are known to those of skill in the art. Preferably, the wheel is a stainless steel blank having CBN bonded to the blank with electro-plated nickel. There are many advantages of using a wheel of this composition. Namely, the wheel can be used directly after cleaning, while still wet, and will not disintegrate. Also, the wheel does not absorb water or fat accumulated on the knife and therefore, will sharpen the blade faster and more efficiently than other sharpening stones presently being used.

Figure 4A:
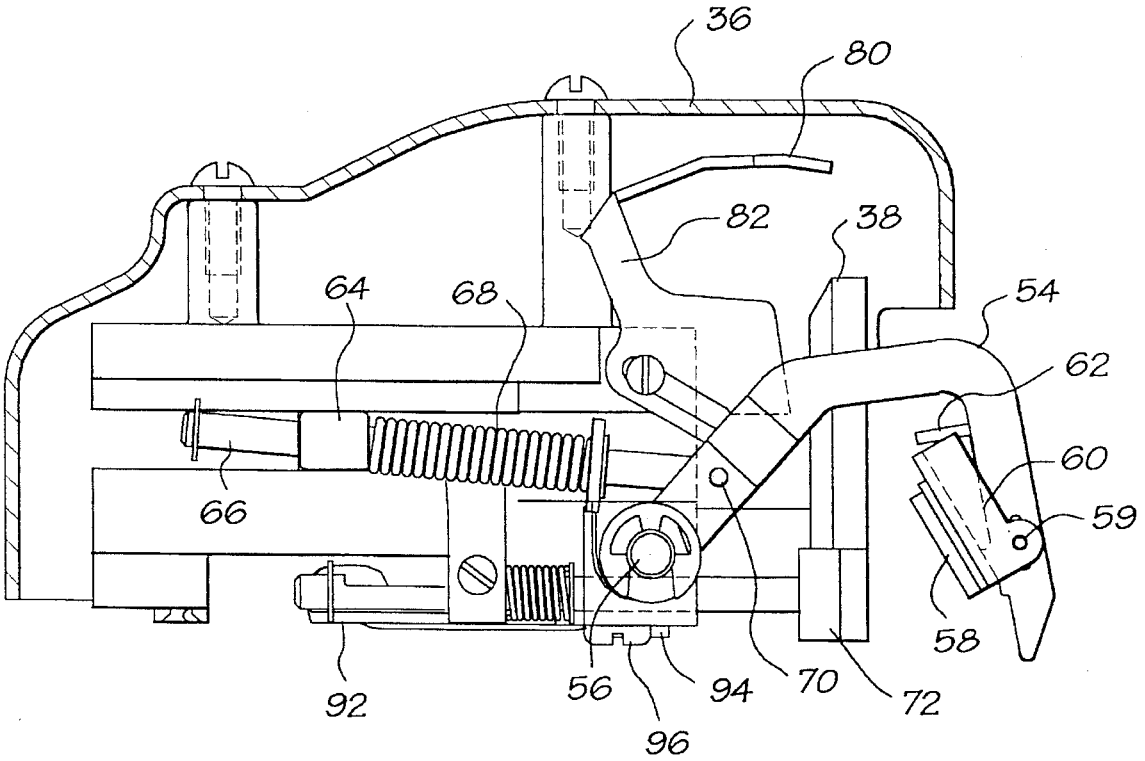
FIG. 4A is a right side elevational view partially in cross-section, of the sharpener assembly of FIG. 1 in an extended, sharpening position.
Figure 4B:
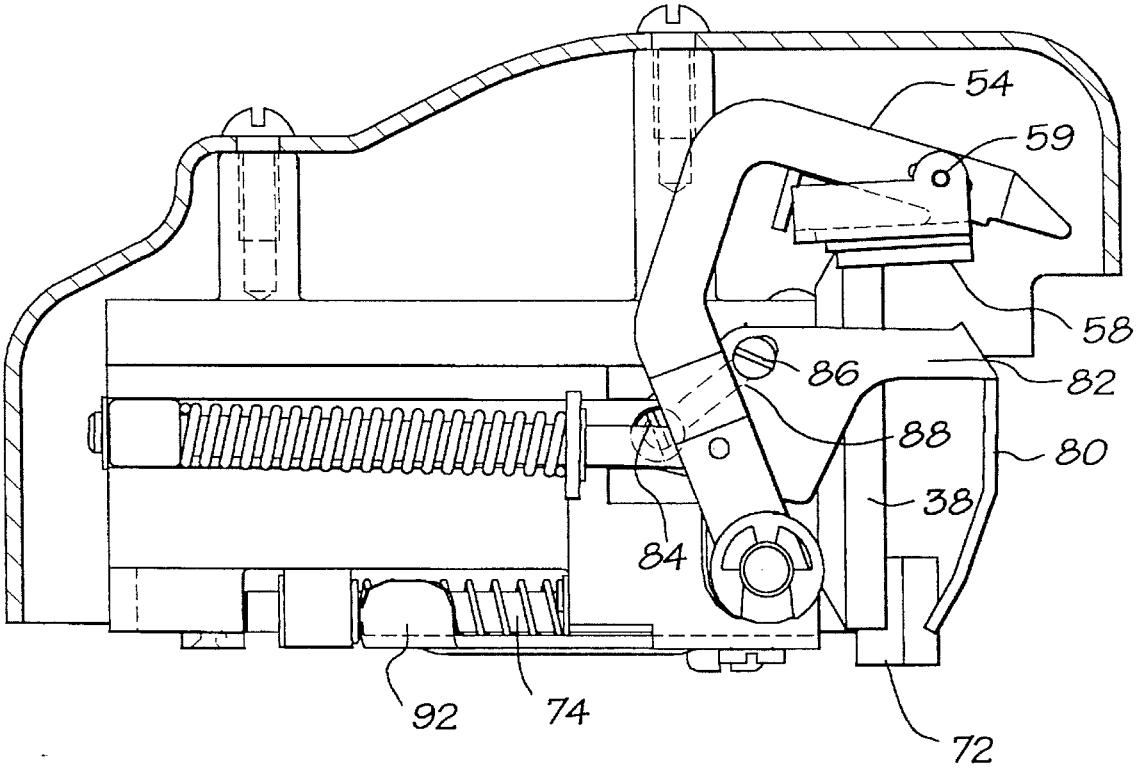
FIG. 4B is the same sharpener assembly of FIG. 4A in a retracted or inactive position.

FIG. 4A is a right side view of the sharpener assembly in the sharpening position showing the extended truing arm 54. FIG. 4B shows FIG. 4A in a retracted, non-sharpening position. The truing arm 54 rotates from a pivot pin 56 on one end and includes a honing stone 58 which cleans and deburrs the front side of the knife as it is being sharpened. The stone 58 is hinged to the opposite end of the arm 54 by pin 59. The truing arm must be long enough and curve a sufficient amount in order to reach over the knife so as to contact the reverse side of the knife during sharpening. The honing stone 58 is smaller than the sharpening stone 38 and can be made of any suitable material. The stone is biased against the knife by a spring 60 that is held in place by a retainer 62.

The truing arm 54 is maneuvered into sharpening position by means of an actuator arm 64 which is a unitary part of actuator body 50. Thus when the actuator body 50 is moved forward by application of the cam lever, the arm 64 slides over rod 66. Rod 66 is attached to the truing arm 54 between pivot 56 and the truing stone at a pivot 70 and is surrounded by an actuator spring 68 which biases the truing arm 54 about its associated pivot 56 when spring is compressed by movement of arm 64 along the rod. When the truing stone 58 contacts the knife, the actuator spring 68 is compressed.

The sharpener assembly is constructed such that the sharpener can be actuated with the knife top cover 108 (as shown in FIG. 1) in place. The truing arm 54 contacts the surface of the knife top cover 108 without damage, due to its spring-biased feature.

Optionally, as shown in the Figures, the sharpener assembly 12 includes a knife scraper 72 and a shutter 80. The scraper 72 is mounted to a shaft 74 and held in place by an anti-rotation screw 76. The scraper 72 is held against the knife by a spring 78 which surrounds the shaft 74. The scraper removes large pieces of fat and other food substances which have been left on the knife blade during slicing, before the sharpening takes place.

The shutter 80 includes a shutter plate 82 having a slot 88 and is rotated about a pivot 84. A pin 86 which is mounted on the sharpener assembly 12 guides the shutter plate 82 as slot 88 moves along pin 86 during rotation of the shutter 80 as shown in FIG. 4B. The shutter 80 covers the sharpening wheel 38 to protect the sharpening wheel from food debris when not in use.

FIG. 5 shows the bottom view of the sharpener assembly without the base assembly. FIG. 5 also includes the additional feature of the scraper 72°. As seen from this bottom view, the actuators arms 64 are both driven by the actuator body 50 so that all of the sharpener wheel 38, truing stone 58, scraper 72 and shutter 80 may move in unison.

Bleed holes 98 are also provided throughout the sharpener assembly in order to prevent air pressure from disrupting the movement of the actuator body 50, and to allow for cleaning fluids to drain from the sharpener assembly.

The activation of the sharpener will now be described in accordance with the present invention. When the actuation lever 28 is rotated by a user, the cam 30 rotates with respect to the cam roller 32. This movement forces the cam forward which, in turn, applies pressure to the actuator body 50. This pressure on the actuator body 50 compresses the main sharpener spring 48, which urges the plunger body 44 containing shaft 40 forward, towards the knife blade. Concurrently, the actuator arm 64 portion of the actuator body 50 compresses the actuator spring 68 which forces the truing arm 54 into contact with the reverse side of the blade. The rod 66 is biased by spring 68 to rotate the truing arm 54 downwards by applying force to pivot 70.

In addition, if shutter 80 is present, it will be in a closed position over the sharpening stone in an non-sharpening position. However, when the cam lever 28 is actuated, the shutter 80 will also be rotated up to allow the sharpening stone 38 access to the knife. The knife scraper 72, if present, also moves forward from a retracted position during the rotation of the activation lever 28. Therefore, during the sharpening operation, the truing stone 58 applies force to the backside of the knife while the main sharpening stone 38 applies pressure to the front part of the knife.

After sharpening, the actuation lever 28 is rotated back to its inactive position. This motion removes the pressure of the cam 30 on the actuator body 50 which relieves the pressure on the compression springs. Then the truing arm, sharpening stone, and scraper, if present) will return to their respective, inactive positions as shown in FIG. 4B. Also, the shutter 80, if present, moves back in place over the sharpening stone.

To remove the sharpener assembly 12 from the slicer for cleaning or replacement, the locking lever 92 is rotated to release the lock. The locator holes 24 and 26 are simply removed from the mounting pins 20, 22 and the sharpener assembly 12 is lifted off the base assembly 18.

Having described the invention in detail and by reference to preferred embodiments thereof, it will be apparent that modifications and variations are possible without departing from the scope of the invention defined in the appended claims.

What is claimed is:

1. A sharpener for a knife of a food slicer comprising:

a base assembly and a sharpener assembly;

the base assembly including a lever mounted thereto on a pivot, the lever carrying a cam member which extends therefrom;

the sharpener assembly including a housing having a longitudinal cavity therein, a sharpening wheel mounted for rotation on an axle which reciprocates lengthwise in the cavity, a compression spring positioned in the cavity at a base portion of the axle, and an actuator which reciprocates in the cavity, said cavity being positioned on the side of the spring opposite the axle;

wherein upon moving the lever about its pivot, the cam contacts the actuator and moves the actuator in the direction of the axle and compresses the spring, the spring moves the plunger lengthwise within the cavity and urges the sharpening wheel against the knife.

2. The sharpener of claim 1 wherein the axle carrying the sharpening wheel is coaxially, rotatably mounted in a plunger which is telescopically received in the actuator.

3. The sharpener of claim 1 further comprising a truing stone, the truing stone being mounted on an arm which is pivoted into contact with the knife by a rod member upon moving the actuator in the cavity.

4. The sharpener of claim 3 wherein a spring is coaxially wound about the rod member, and the actuator includes a bar which extends therefrom and compresses the spring on the rod member when the actuator is moved into the cavity, the bar thereby causing the rod member to pivot the arm carrying the truing stone into a position in which the truing stone contacts the knife.

5. The sharpener of claim 1 further comprising a secondary compression spring in the cavity for returning the sharpening wheel to a position in which the sharpening wheel does not contact the knife.

6. The sharpener of claim 1 wherein the sharpener assembly is removable from the base assembly.

7. The sharpener of claim 6 wherein the base assembly includes a mount for releasably attaching the sharpener assembly and the sharpener assembly includes a means for releasably mounting the sharpener assembly to the base assembly.

8. The sharpener of claim 1 wherein the sharpener assembly and the base assembly are a single unit.

9. The sharpener of claim 1 wherein the sharpener includes a knife scraper to remove fat on the knife before sharpening.

10. The sharpener of claim 1 wherein the sharpener apparatus further includes a shutter to protect the sharpening stone when not in use.

11. A food slicer comprising:

a slicer base and a knife rotatably mounted on a shaft in the base, a base assembly and a sharpener assembly;

the base assembly including a lever mounted thereto on a pivot, the lever carrying a cam member which extends therefrom;

the sharpener assembly including a housing having a longitudinal cavity therein, a sharpening wheel mounted for rotation on an axle which reciprocates lengthwise in the cavity, a compression spring positioned in the cavity at a base portion of the axle, and an actuator which reciprocates in the cavity, said cavity being positioned on the side of the spring opposite the axle;

wherein upon moving the lever about its pivot, the cam contacts the actuator and moves the actuator in the direction of the axle and compresses the spring, the spring moves the plunger lengthwise within the cavity and forces the sharpening wheel against the knife.

12. The food slicer of claim 11 wherein the axle carrying the sharpening wheel is coaxially, rotatably mounted in a plunger which is telescopically received in the actuator.

13. The food slicer of claim 11 further comprising a truing stone, the truing stone being mounted on an arm which is pivoted into contact with the knife by a rod member upon moving the actuator in the cavity.

14. The food slicer of claim 13 wherein a spring is coaxially wound about the rod member, and the actuator includes a bar which extends therefrom and compresses the spring on the rod member when the actuator is moved into the cavity, the bar thereby causing the rod member to pivot the arm carrying the truing stone into a position in which the truing stone contacts the knife.

15. The food slicer of claim 11 further comprising a secondary compression spring in the cavity for returning the sharpening wheel to a position in which the sharpening stone does not contact the knife.

16. The food slicer of claim 11 wherein the sharpener assembly is removable from the base assembly.

17. The food slicer of claim 16 wherein the base assembly includes a mount for releasably attaching the sharpener assembly and the sharpener assembly includes a means for releasably mounting the sharpener assembly to the base assembly.

18. The food slicer of claim 11 wherein the sharpener includes a knife scraper to remove fat on the knife before sharpening.

19. The food slicer of claim 11 wherein the sharpener apparatus further includes a shutter to protect the sharpening wheel when not in use.

20. The food slicer of claim 11 wherein the base assembly is mounted at an angle to the knife so that the sharpening wheel comes into contact with the knife at an angle.

21. A sharpener for a knife of a food slicer comprising:

a base assembly and a sharpener assembly removably attached to the base assembly;

the base assembly including a lever mounted thereto on a pivot and a mount for releasably attaching the sharpener assembly, the lever carrying a cam member which extends therefrom;

the sharpener assembly including a means for releasably securing the sharpener assembly to the base assembly, a housing having a longitudinal cavity therein, a sharpening wheel mounted on an axle which is coaxially carried in a plunger which reciprocates lengthwise in the cavity, a compression spring positioned in the cavity at a base portion of the axle, and an actuator which reciprocates in the cavity, said cavity being positioned on the side of the spring opposite the axle;

a truing stone mounted on an arm having a pivot, and a rod member having a spring coaxially wound therearound, said actuator further including a bar which extends therefrom and compresses the spring coaxially wound around the rod member when the bar is moved with respect to the rod member;

wherein upon moving the lever about its pivot, the cam contacts the actuator and moves the actuator in the direction of the axle and compresses the compression spring, the spring moves the plunger lengthwise within the cavity and forces the sharpening wheel against the knife, the rod member causes the arm carrying the truing stone to pivot into a position in which the truing stone contacts the knife.

* * * * *